US011181110B2

(12) United States Patent
Hebrard et al.

(10) Patent No.: US 11,181,110 B2
(45) Date of Patent: Nov. 23, 2021

(54) SCREW COMPRESSOR FOR A UTILITY VEHICLE

(71) Applicant: KNORR-BREMSE Systeme fuer Nutzfahrzeuge GmbH, Munich (DE)

(72) Inventors: Gilles Hebrard, Munich (DE); Jean-Baptiste Marescot, Munich (DE); Joerg Mellar, Munich (DE); Thomas Weinhold, Munich (DE)

(73) Assignee: KNORR-BREMSE Systeme fuer Nutzfahrzeuge GmbH, Munich (DE)

( * ) Notice: Subject to any disclaimer, the term of this patent is extended or adjusted under 35 U.S.C. 154(b) by 190 days.

(21) Appl. No.: 16/295,781

(22) Filed: Mar. 7, 2019

(65) Prior Publication Data

US 2019/0203718 A1 Jul. 4, 2019

Related U.S. Application Data

(63) Continuation of application No. PCT/EP2017/073535, filed on Sep. 19, 2017.

(30) Foreign Application Priority Data

Sep. 21, 2016 (DE) ..... 10 2016 011 443.6

(51) Int. Cl.
*F01C 21/04* (2006.01)
*F03C 2/00* (2006.01)
(Continued)

(52) U.S. Cl.
CPC ..... *F04C 29/04* (2013.01); *F01C 21/007* (2013.01); *F01C 21/10* (2013.01); *F04C 18/12* (2013.01);
(Continued)

(58) Field of Classification Search
CPC ..... F04C 18/023; F04C 18/12; F04C 18/16; F04C 29/02; F04C 29/04;
(Continued)

(56) References Cited

U.S. PATENT DOCUMENTS 4,748,873 A 6/1988 Snyder
4,780,061 A 10/1988 Butterworth
(Continued)

FOREIGN PATENT DOCUMENTS

DE 37 17 493 A1 11/1987
DE 100 33 154 A1 1/2002
(Continued)

OTHER PUBLICATIONS

DE102014004726A1—Bauer et al.—Separating device has pre-separation unit and oil filter unit, which are arranged in cartridge-shaped separator housing.—Oct. 9, 2014—English Machined Translation (Year: 2014).*
(Continued)

*Primary Examiner* — Theresa Trieu
(74) *Attorney, Agent, or Firm* — Crowell & Moring LLP

(57) ABSTRACT

A screw compressor for a utility vehicle includes a housing. The housing is filled with oil. At least one pair of compressor screws are mounted in the housing and serve to compress air supplied to the screw compressor. In the assembled state, a heat exchanger is directly placed onto and installed on the housing, by which heat exchanger the temperature of the oil contained in the housing can be controlled.

10 Claims, 4 Drawing Sheets

(51) Int. Cl.

| | |
|---|---|
| ***F03C 4/00*** | (2006.01) |
| ***F04C 2/00*** | (2006.01) |
| ***F04C 15/00*** | (2006.01) |
| ***F04C 29/04*** | (2006.01) |
| ***F04C 29/02*** | (2006.01) |
| ***F01C 21/10*** | (2006.01) |
| ***F01C 21/00*** | (2006.01) |
| ***F04C 18/16*** | (2006.01) |
| ***F04C 18/12*** | (2006.01) |
| *F04C 18/02* | (2006.01) |

(52) U.S. Cl.
CPC ..... *F04C 18/16* (2013.01); *F04C 29/02* (2013.01); *F04C 18/023* (2013.01); *F04C 2210/1005* (2013.01); *F04C 2240/30* (2013.01); *F04C 2240/805* (2013.01); *F04C 2240/806* (2013.01)

(58) Field of Classification Search
CPC ..... F04C 2210/1005; F04C 2240/30; F04C 2240/805; F04C 2240/806; F01C 21/007; F01C 21/10
See application file for complete search history.

(56) References Cited

U.S. PATENT DOCUMENTS

| | | | | |
|---|---|---|---|---|
| 6,672,102 | B1 * | 1/2004 | Huenniger | F25B 1/047 62/472 |
| 7,600,982 | B2 * | 10/2009 | Koeck | F04C 18/16 418/201.1 |
| 2005/0019169 | A1 | 1/2005 | Kriehn et al. | |
| 2009/0252632 | A1 * | 10/2009 | Daniels | F04C 29/02 418/84 |
| 2010/0233006 | A1 * | 9/2010 | Yamamoto | F04C 18/16 418/206.3 |
| 2011/0014077 | A1 * | 1/2011 | Martens | F04C 29/02 418/84 |
| 2012/0034110 | A1 | 2/2012 | Dreifert et al. | |
| 2014/0017110 | A1 | 1/2014 | Zemliak | |

FOREIGN PATENT DOCUMENTS

| | | | | |
|---|---|---|---|---|
| DE | 101 56 179 | A1 | 5/2003 | |
| DE | 602 03 272 | T2 | 2/2006 | |
| DE | 10 2009 018 212 | A1 | 10/2010 | |
| DE | 10 2011 014 961 | A1 | 9/2012 | |
| DE | 10 2014 004 726 | A1 | 10/2014 | |
| DE | 20 2013 008 468 | U1 | 2/2015 | |
| JP | 1-108380 | U | 7/1989 | |
| JP | 04314991 | A * | 11/1992 | F04C 29/023 |
| JP | 2002-115690 | A | 4/2002 | |
| JP | 2005-48593 | A | 2/2005 | |
| JP | 2008-523315 | A | 7/2008 | |
| JP | 2010-138881 | A | 6/2010 | |
| WO | WO 02/084124 | A1 | 10/2002 | |

OTHER PUBLICATIONS

JP2005048593A—Kametani et al.—Oil-Cooled Air Compressor—Feb. 24, 2005—English Machined Translation (Year: 2005).*
JPH04314991A—Kametani et al.—Lubricating Oil Cooling Structure for Screw Vacuum Pump—Nov. 6, 1992—English Translation of Description. (Year: 1992).*
Japanese-language Office Action issued in Japanese Application No. 2019-536663 dated May 19, 2020 with English translation (14 pages).
International Search Report (PCT/ISA/210) issued in PCT Application No. PCT/EP2017/073535 dated Nov. 27, 2017 with English translation (six (6) pages).
German-language Written Opinion (PCT/ISA/237) issued in PCT Application No. PCT/EP2017/073535 dated Nov. 27, 2017 (six (6) pages).
German-language Search Report issued in counterpart German Application No. 10 2016 011 443.6 dated Jul. 24, 2017 (five (5) pages).

* cited by examiner

SCREW COMPRESSOR FOR A UTILITY VEHICLE

CROSS REFERENCE TO RELATED APPLICATIONS

This application is a continuation of PCT International Application No. PCT/EP2017/073535, filed Sep. 19, 2017, which claims priority under 35 U.S.C. § 119 from German Patent Application No. 10 2016 011 443.6, filed Sep. 21, 2016, the entire disclosures of which are herein expressly incorporated by reference.

BACKGROUND AND SUMMARY OF THE INVENTION

The present invention relates to a screw compressor for a utility vehicle.

Screw compressors for utility vehicles are already known from the prior art. Such screw compressors are used to provide the compressed air required, for example, for the brake system of the utility vehicle.

In this context, in particular oil-filled compressors, in particular also screw compressors, are known, in the case of which it is necessary to regulate the oil temperature. This is generally realized by virtue of an external oil cooler being provided which is connected to the oil-filled compressor and to the oil circuit via a thermostat valve. Here, the oil cooler is a heat exchanger which has two mutually separate circuits, wherein the first circuit is provided for the hot liquid, that is to say the compressor oil, and the second circuit is provided for the cooling liquid. As cooling liquid, use may for example be made of air, water mixtures with an antifreeze, or another oil.

This oil cooler must then be connected to the compressor oil circuit by means of pipes or hoses, and the oil circuit must be safeguarded against leakage.

This external volume must furthermore be filled with oil, such that the total quantity of oil is also increased. The system inertia is thus increased. Furthermore, the oil cooler must be mechanically accommodated and fastened, either by use of brackets situated in the surroundings or by use of a separate bracket, which necessitates additional fastening means and also structural space.

U.S. Pat. No. 4,780,061 has already disclosed a screw compressor with an integrated oil cooling arrangement.

Furthermore, DE 37 17 493 A1 discloses a screw compressor installation which is arranged in a compact housing and which has an oil cooler on the electric motor of the screw compressor.

It is the object of the present invention to advantageously further develop a screw compressor for a utility vehicle of the type mentioned in the introduction, in particular such that said screw compressor is of simpler construction and the thermal inertia of the overall system can be reduced.

According to the invention, a screw compressor for a utility vehicle is equipped with a housing, wherein the housing is filled with oil. The screw compressor furthermore has at least one pair of compressor screws (also referred to as compressor rotors) which are mounted in the housing and which serve for compressing fluid, in particular air, which is fed to the screw compressor. In the assembled state of the screw compressor, a heat exchanger is mounted and installed directly onto the housing, by which heat exchanger the temperature of the oil contained in the housing can be regulated.

The invention is based on the underlying concept that, by virtue of the heat exchanger being mounted directly on the housing, the total required volume, and also dead volume, of oil can be reduced. In particular, by virtue of the heat exchanger being mounted directly on the housing of the screw compressor, there is no need for long connecting paths from the screw compressor housing into the heat exchanger. Rather, the oil can be introduced directly from the screw compressor into the heat exchanger. The required oil volume is thus kept relatively small. The thermal inertia of the system is reduced. In other words, the dead volume, or the volume that must be filled with oil in order to fill the lines between housing interior and heat exchanger with oil and permit an oil circulation, is thus reduced. Furthermore, in this way, the risk of leakage is greatly reduced because the required lines outside the housing must be avoided, or at least have a shorter length requirement.

In relation to the hitherto known screw compressors, in particular in the start-up phase, the oil is brought to operating temperature quickly if the oil, regulated by the thermostat, initially does not flow through the heat exchanger/cooler at all and thus reaches the operating temperature quickly.

Provision may furthermore be made for the housing to have a ring-shaped attachment piece for receiving the heat exchanger. By means of the ring-shaped attachment piece, it is made possible to permit simple and correct positioning of the heat exchanger on the housing. By means of the ring-shaped attachment piece, it is furthermore also possible to easily realize a simple and reliable sealing facility in both an axial and a radial direction.

Provision may furthermore be made for two ring-shaped attachment pieces to be provided in the housing, which can serve for the fastening of the heat exchanger to the housing of the screw compressor. By means of the double ring-shaped attachment piece, the sealing action can be improved, because it is for example possible for a type of labyrinth seal to be made possible in this way. Provision may also be made to utilize the intermediate space between the walls of the ring-shaped attachment pieces as a fluid line between housing and heat exchanger.

In particular, provision may be made for the ring-shaped attachment pieces to be formed concentrically. This facilitates a positioning of the heat exchanger on the housing. Furthermore, a concentric arrangement of the ring-shaped attachment pieces is also expedient with regard to the sealing action required in order to correspondingly seal off the heat exchanger mounted on the housing at the interface to the housing.

Provision may furthermore be made for the housing to have a receptacle for a screw for the fastening of the heat exchanger. In this way, a simple fastening of the heat exchanger to the housing by means of a screw can be made possible.

In particular, it is contemplated for the receptacle for the screw to be received in the interior of the two ring-shaped attachment pieces. In this way, it is possible for the centering of the heat exchanger by means of the two ring-shaped attachment pieces and the fastening by means of the screw, which is received in the interior of the two ring-shaped attachment pieces, to be achieved with substantially one simple working step.

Provision may be made for the screw for the fastening of the heat exchanger to be a hollow screw. Via the hollow screw, it is made possible for oil to be fed to the heat exchanger or for oil to be returned via the hollow screw from the heat exchanger into the housing of the screw compressor.

In particular, provision may be made for the hollow screw to serve as a fluid channel for the oil conducted to the heat exchanger and/or the oil conducted from the heat exchanger back into the housing.

It is contemplated for the heat exchanger to be of air-cooled design.

The heat exchanger may be of water-cooled design. For example, provision may be made for the cooling water to have antifreeze, for example methylene glycol or the like, added to it.

Furthermore, a thermostat and an open-loop and/or closed-loop control device may be provided, by means of which the oil temperature of the oil situated in the housing can be monitored and set to a setpoint value. In this way, it is made possible for the heat exchanger to be used only when necessary. It is thus made possible for the operating temperature to be reached more quickly for example upon the start-up of the screw compressor.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
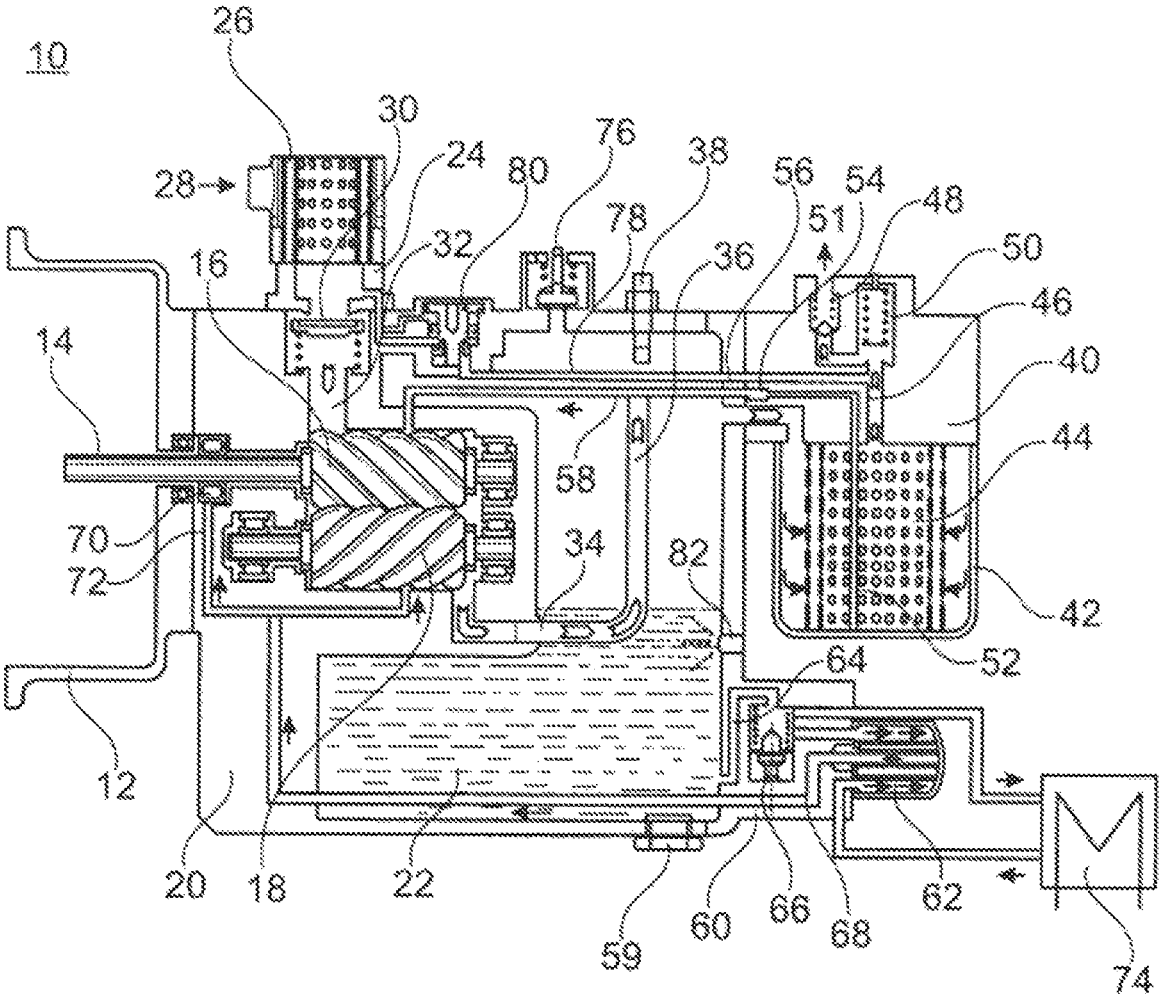
FIG. 1 shows a schematic sectional drawing through a screw compressor according to an embodiment of the invention.

FIG. 1 shows, in a schematic sectional illustration, a screw compressor 10 in the context of an exemplary embodiment of the present invention.

The screw compressor 10 has a fastening flange 12 for the mechanical fastening of the screw compressor 10 to an electric motor (not shown in any more detail here).

What is shown, however, is the input shaft 14, by which the torque from the electric motor is transmitted to one of the two screws 16 and 18, specifically the screw 16.

The screw 18 meshes with the screw 16 and is driven by means of the latter.

The screw compressor 10 has a housing 20 in which the main components of the screw compressor 10 are accommodated.

The housing 20 is filled with oil 22.

At the air inlet side, an inlet connector 24 is provided on the housing 20 of the screw compressor 10. The inlet connector 24 is in this case designed such that an air filter 26 is arranged at said inlet connector. Furthermore, an air inlet 28 is provided radially on the air inlet connector 24.

In the region between the inlet connector 24 and the point at which the inlet connector 24 joins to the housing 20, there is provided a spring-loaded valve insert 30, which is designed here as an axial seal.

Said valve insert 30 serves as a check valve.

Downstream of the valve insert 30, there is provided an air feed channel 32 which feeds the air to the two screws 16, 18.

At the outlet side of the two screws 16, 18, there is provided an air outlet pipe 34 with a riser line 36.

In the region of the end of the riser line 36, there is provided a temperature sensor 38 by means of which the oil temperature can be monitored.

Also provided in the air outlet region is a holder 40 for an air deoiling element 42.

In the assembled state, the holder 40 for the air deoiling element has the air deoiling element 42 in the region facing toward the base (as also shown in FIG. 1).

Also provided, in the interior of the air deoiling element 42, is a corresponding filter screen or known filter and oil separating devices 44, which will not be specified in any more detail.

In the central upper region in relation to the assembled and operationally ready state (that is to say as shown in FIG. 1), the holder for the air deoiling element 40 has an air outlet opening 46 which leads to a check valve 48 and a minimum pressure valve 50. The check valve 48 and the minimum pressure valve 50 may also be formed in one common combined valve.

The air outlet 51 is provided downstream of the check valve 48.

The air outlet 51 is generally connected to correspondingly known compressed-air consumers.

In order for the oil 22 that is situated and separated off in the air deoiling element 42 to be returned again into the housing 20, a riser line 52 is provided which has a filter and check valve 54 at the outlet of the holder 40 for the air deoiling element 42 at the transition into the housing 20.

A nozzle 56 is provided, downstream of the filter and check valve 54, in a housing bore. The oil return line 58 leads back into approximately the central region of the screw 16 or of the screw 18 in order to feed oil 22 thereto again.

An oil drain screw 59 is provided in the base region, in the assembled state, of the housing 20. By means of the oil drain screw 59, a corresponding oil outflow opening can be opened, via which the oil 22 can be drained.

Also provided in the lower region of the housing 20 is the attachment piece 60 to which the oil filter 62 is fastened. Via an oil filter inlet channel 64, which is arranged in the housing 20, the oil 22 is conducted firstly to a thermostat valve 66.

Instead of the thermostat valve 66, it is possible for an open-loop and/or closed-loop control device to be provided by means of which the oil temperature of the oil 22 situated in the housing 20 can be monitored and set to a setpoint value.

Downstream of the thermostat valve 66, there is then the oil inlet of the oil filter 62, which, via a central return line 68, conducts the oil 22 back to the screw 18 or to the screw 16 again, and also to the oil-lubricated bearing 70 of the shaft 14. Also provided in the region of the bearing 70 is a nozzle 72, which is provided in the housing 20 in conjunction with the return line 68.

The cooler 74 is connected to the attachment piece 60, as will be discussed in more detail below in FIGS. 2 to 4.

In the upper region of the housing 20 (in relation to the assembled state), there is situated a safety valve 76, by means of which an excessively high pressure in the housing 20 can be dissipated.

Upstream of the minimum pressure valve 50, there is situated a bypass line 78, which leads to a relief valve 80. Via said relief valve 80, which is activated by means of a connection to the air feed 32, air can be returned into the region of the air inlet 28. In this region, there may be provided a ventilation valve (not shown in any more detail) and also a nozzle (diameter constriction of the feeding line).

Furthermore, approximately at the level of the air outlet pipe 34, an oil level sensor 82 may be provided in the outer wall of the housing 20. Said oil level sensor 82 may for example be an optical sensor, and may be designed and configured such that, on the basis of the sensor signal, it can be identified whether the oil level during operation is above the oil level sensor 82 or whether the oil level sensor 82 is exposed, and thus the oil level has correspondingly fallen.

In conjunction with this monitoring, it is also possible for an alarm unit to be provided which outputs or transmits a corresponding error message or warning message to the user of the system.

The function of the screw compressor 10 shown in FIG. 1 is as follows:

Air is fed via the air inlet 28 and passes via the check valve 30 to the screws 16, 18, where the air is compressed. The compressed air-oil mixture, which, having been compressed by a factor of between 5 and 16 downstream of the screws 16 and 18, rises through the outlet line 34 via the riser pipe 36, is blown directly onto the temperature sensor 38.

The air, which still partially carries oil particles, is then conducted via the holder 40 into the air deoiling element 42 and, if the corresponding minimum pressure is attained, passes into the air outlet line 51.

The oil 22 situated in the housing 20 is kept at operating temperature via the oil filter 62 and possibly via the heat exchanger 74.

If no cooling is necessary, the heat exchanger 74 is not used and is also not activated.

The corresponding activation is performed by means of the thermostat valve 66. After purification in the oil filter 64, oil is fed via the line 68 to the screw 18 or to the screw 16, and also to the bearing 70. The screw 16 or the screw 18 is supplied with oil 22 via the return line 52, 58, and the purification of the oil 22 takes place here in the air deoiling element 42.

By means of the electric motor (not shown in any more detail), which transmits its torque via the shaft 14 to the screw 16, which in turn meshes with the screw 18, the screws 16 and 18 of the screw compressor 10 are driven.

By means of the relief valve 80 (not shown in any more detail), it is ensured that the high pressure that prevails for example at the outlet side of the screws 16, 18 in the operational state cannot be enclosed in the region of the feed line 32, and that, instead, in particular during the start-up of the compressor, there is always a low inlet pressure, in particular atmospheric pressure, prevailing in the region of the feed line 32. Otherwise, upon a start-up of the compressor, a very high pressure would initially be generated at the outlet side of the screws 16 and 18, which would overload the drive motor.

Figure 2:
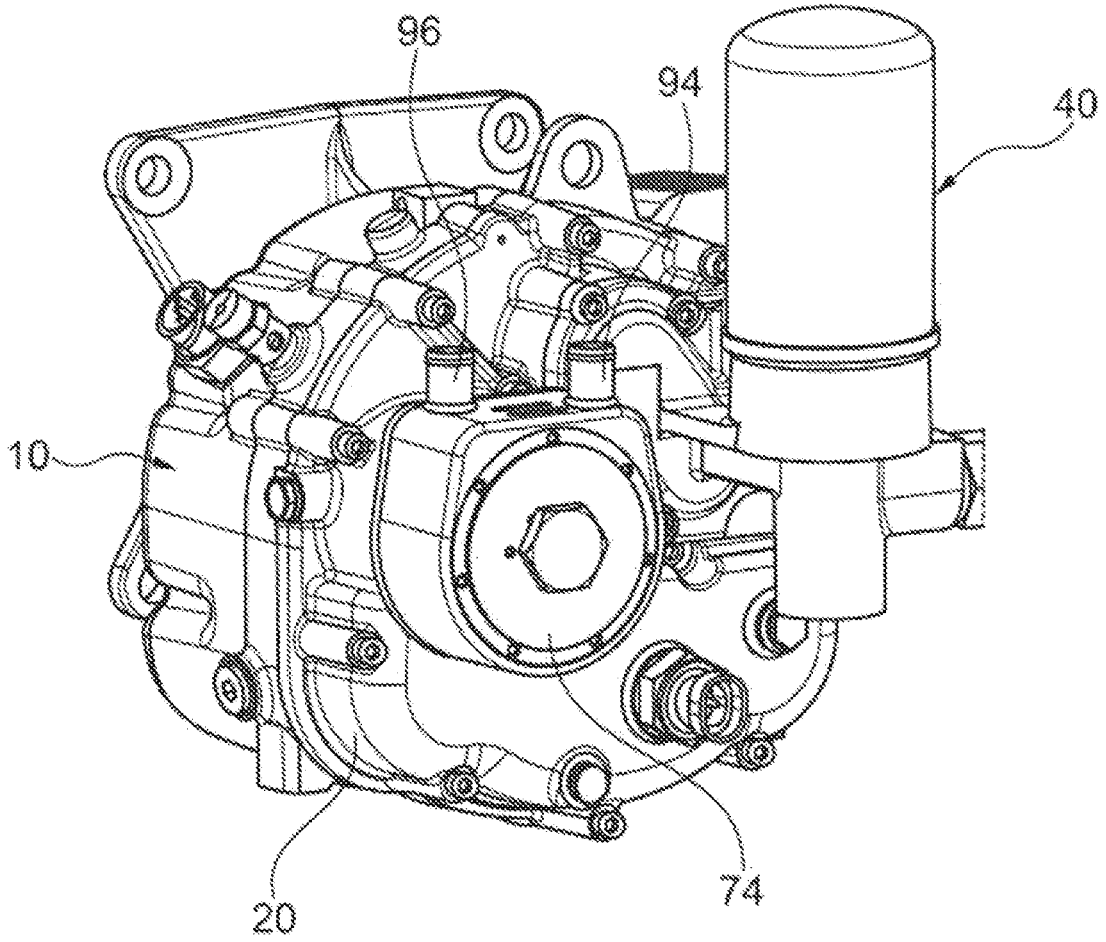
FIG. 2 shows a perspective view of a screw compressor.

FIG. 2 now shows a perspective view of the heat exchanger 74, which is mounted directly on the housing 20.

In the assembled state, the heat exchanger 74 is thus mounted and installed directly on the housing 20, wherein the temperature of the oil 22 contained in the housing 20 can be regulated by means of the heat exchanger 74.

Figure 3:
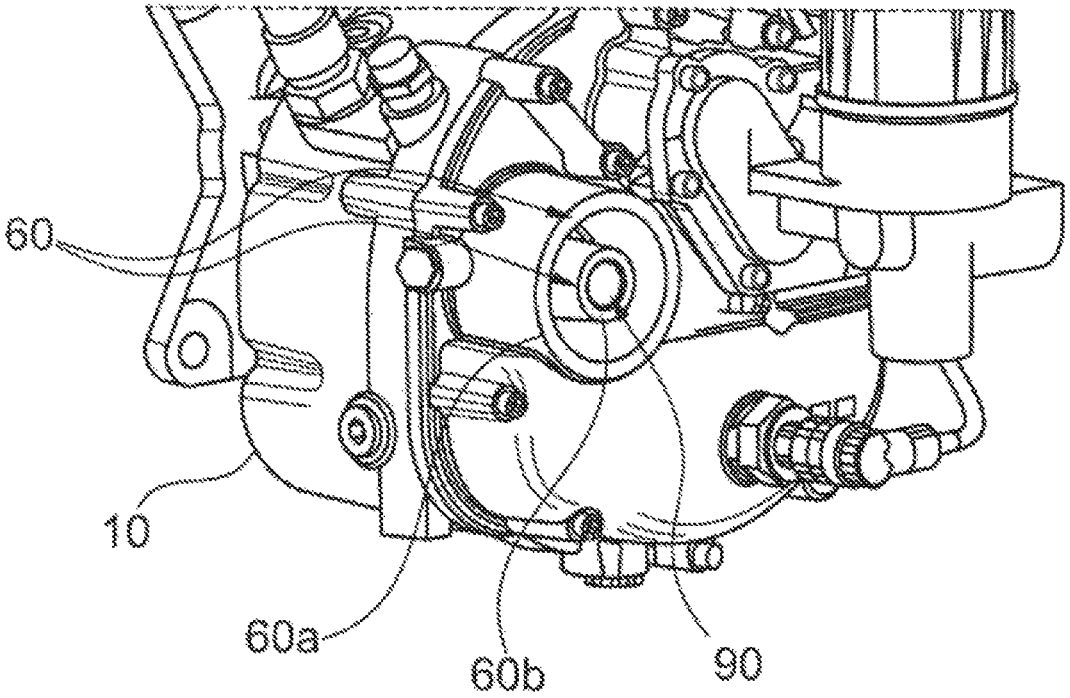
FIG. 3 shows a further perspective view of a screw compressor as per FIG. 2.

As is also shown in FIG. 3, a double concentric radial attachment piece 60 with an outer ring 60*a* and an inner ring 60*b* is provided for the fastening of the heat exchanger 74.

In the interior of the radial attachment piece 60*b* there is provided a receptacle 90 which serves for the screwing-in of a hollow screw 92.

Figure 4:
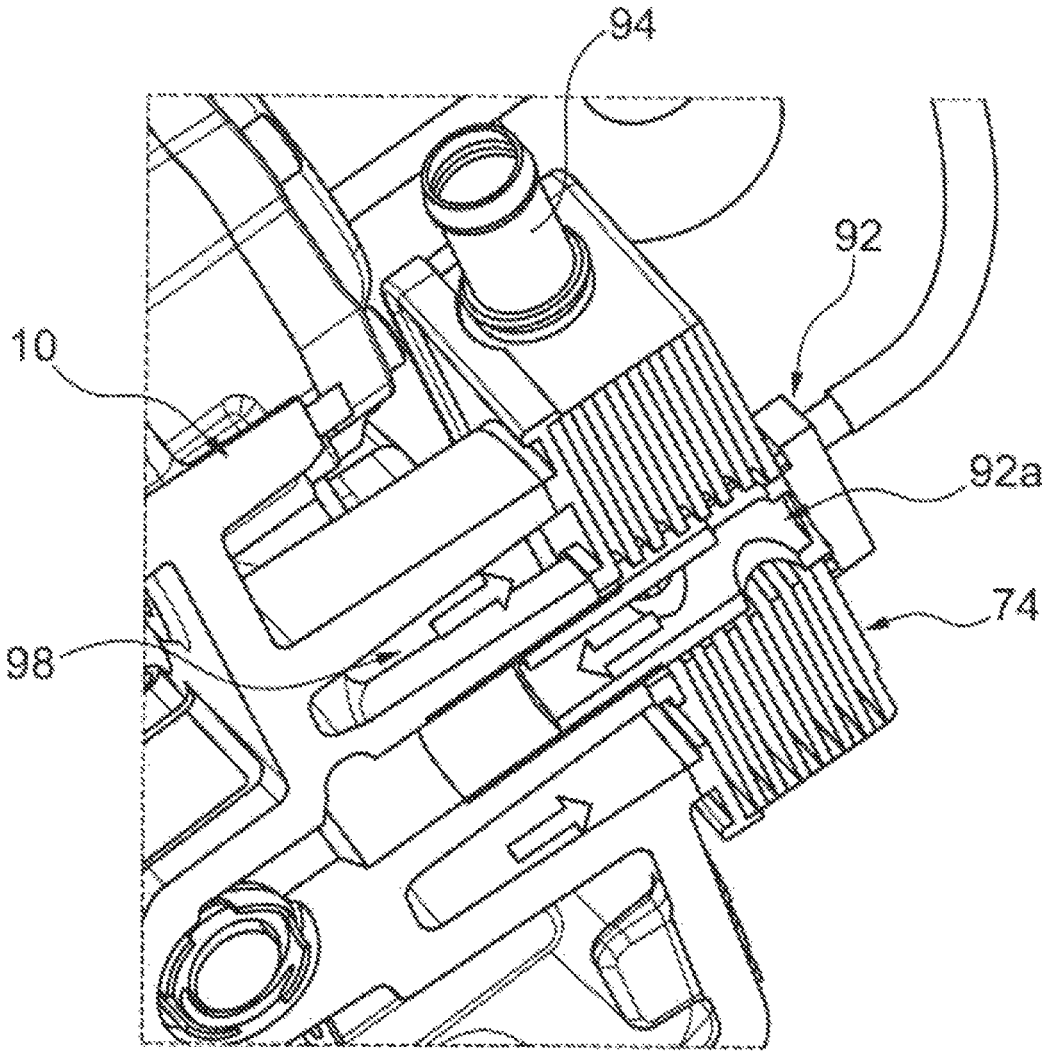
FIG. 4 shows a schematic, perspective sectional drawing through the heat exchanger and a part of the housing of the screw compressor as per FIG. 2.

Here, the hollow screw 92 serves firstly for the fixing of the oil cooler 74 but also, as shown in FIG. 4, for the return of the oil 22, which has been conducted through the oil cooler 74 and cooled, back into the housing 20 through the hollow screw inner channel 92*a*. The region 98 between the concentric ring-shaped attachment pieces 60*a* and 60*b* is used to feed oil 22 to the oil cooler 74.

Here, the oil cooler 74 is designed to be water-cooled (in particular water-cooled with the addition of antifreeze). In a further embodiment, use may also be made of an air-cooled heat exchanger.

The coolant is fed via the connections 94, 96 (see FIGS. 2 and 4).

As shown in FIG. 4, the heat exchanger structure is in this case of lamellar form, or is formed in this case as a known and proven multiplate structure.

LIST OF REFERENCE DESIGNATIONS

10 Screw compressor
12 Fastening flange
14 Input shaft
16 Screws
18 Screws
20 Housing
22 Oil
24 Inlet connector
26 Air filter
28 Air inlet
30 Valve insert
32 Air feed channel
34 Air outlet pipe
36 Riser line
38 Temperature sensor
40 Holder for an air deoiling element
42 Air deoiling element
44 Filter screen or known filter or oil separation devices
46 Air outlet opening
48 Check valve
50 Minimum pressure valve
51 Air outlet
52 Riser line
54 Filter and check valve
56 Nozzle
58 Oil return line
59 Oil drain screw
60 Attachment piece
60*a* Outer ring
60*b* Inner ring
62 Oil filter
64 Oil filter inlet channel
66 Thermostat valve
68 Return line
70 Bearing
72 Nozzle
74 Cooler, heat exchanger
76 Safety valve
78 Bypass line
80 Relief valve
82 Oil level sensor
90 Receptacle
92 Hollow screw
92*a* Hollow screw inner channel
94 Connection
96 Connection
98 Region The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A screw compressor for a utility vehicle, comprising:

a housing, wherein the housing is filled with oil;

at least one pair of compressor screws which are mounted in the housing and which serve for compressing air which is fed to the screw compressor; and a heat exchanger, wherein the heat exchanger is mounted directly on the housing of the screw compressor in an assembled state, by which heat exchanger a temperature of the oil contained in the housing is regulatable, wherein, via the heat exchanger mounted directly on the housing of the screw compressor, the oil is introducible directly from the housing of the screw compressor into the heat exchanger;

wherein for fastening the heat exchanger, two ring-shaped attachment pieces are provided on the housing.

2. The screw compressor as claimed in claim 1, wherein the two ring-shaped attachment pieces are arranged concentrically with respect to one another.

3. The screw compressor as claimed in claim 1, wherein the housing has a receptacle for a screw for fastening the heat exchanger.

4. The screw compressor as claimed in claim 3, wherein the receptacle for the screw is received in the interior of the two ring-shaped attachment pieces.

5. The screw compressor as claimed in claim 3, wherein the screw is a hollow screw.

6. The screw compressor as claimed in claim 5, wherein the hollow screw serves as a fluid channel for the oil conducted to the heat exchanger or the oil conducted from the heat exchanger back into the housing.

7. The screw compressor as claimed in claim 1, wherein the heat exchanger is water-cooled.

8. The screw compressor as claimed in claim 7, wherein the heat exchanger is water-cooled by a water-antifreeze mixture.

9. The screw compressor as claimed in claim 1, wherein the heat exchanger is air-cooled.

10. The screw compressor as claimed in claim 1, further comprising:

a thermostat and an open-loop or closed-loop control device by which the oil temperature of the oil situated in the housing is monitored and set to a setpoint value.

* * * * *